US005657695A

United States Patent [19]

Lanoix et al.

[11] Patent Number: 5,657,695

[45] Date of Patent: Aug. 19, 1997

[54] REVERSIBLE RACE TRACK SYSTEM

[75] Inventors: Réal Lanoix, Laval; Jean-Christophe Doyon, Verdun; Gilles Collin, Laval; Daniel Bourgeois, Sainte-Rose, all of Canada

[73] Assignee: The Ritvik Group Inc., Quebec, Canada

[21] Appl. No.: 589,616

[22] Filed: Jan. 22, 1996

[51] Int. Cl.[6] ..... E01B 23/00

[52] U.S. Cl. ..... 104/126; 104/125; 104/140; 104/130.09; 238/10 F; 238/10 A

[58] Field of Search ..... 238/10 R, 10 A, 238/10 B, 10 E, 10 F; 104/53, 55, 60, 124, 125, 126, 140, 130.09

[56] References Cited

U.S. PATENT DOCUMENTS

| | | | |
|---|---|---|---|
| Re. 32,106 | 4/1986 | Lemelson | 238/10 F |
| 3,464,624 | 9/1969 | Christiansen | 238/10 E |
| 3,630,524 | 12/1971 | Cooper | 238/10 F |
| 3,734,404 | 5/1973 | Baynes et al. | 238/10 E |
| 4,403,733 | 9/1983 | Bach et al. | 238/10 E |

FOREIGN PATENT DOCUMENTS

| | | | |
|---|---|---|---|
| 254679 | 1/1988 | European Pat. Off. | 238/10 E |
| 2223957 | 10/1974 | France | 238/10 F |

*Primary Examiner*—Mark T. Le
*Attorney, Agent, or Firm*—Michael D. Bednarek; Kilpatrick Stockton LLP

[57] ABSTRACT

A reversible track section for a toy car circuit. The reversible track section has a length, two opposite ends, two opposite sides, a top surface and a bottom surface. The reversible track section includes a thin, elongated plate including a central recess on the top surface. The central recess is of given height and rectangular cross-section and extends over the length defining two narrow pathways on the bottom surface, and includes a pair of longitudinal flanges on each of the opposite sides extending perpendicular to the top surface and towards the bottom surface. The longitudinal flanges are of the same height as the central recess and each is provided with an integral, outwardly projecting extension of constant width. The extension has a top surface, a bottom surface, a lateral surface, a thickness smaller than the height of the corresponding longitudinal flange, including a central portion and opposite ends thicker than the central portion, provided with alternating studs and cavities along the length on both the extension top and bottom surfaces and with an outwardly projecting stud extending perpendicularly to the lateral surface on each of the end portions. In a pit, a plurality of the reversible track sections may be interconnected in series with the top surface oriented upwardly to form a "grand prix" circuit for a wheeled vehicle having a downwardly projecting pin designed to fit into the central recess to help guide the wheeled vehicle around the circuit, or, alternatively, the plurality of reversible track sections may be reversed and interconnected in series with the bottom surface oriented upwardly to form a "speedway" circuit for a pair of wheeled vehicles designed to fit within the two narrow pathways, where some of the reversible track sections are straight and some of the reversible track section are curved. A "grand prix" circuit may also include a directional switch for assembling more than one loop or may include a self-operating stopping pit.

21 Claims, 10 Drawing Sheets

REVERSIBLE RACE TRACK SYSTEM

FIELD OF THE INVENTION

The present invention relates to a reversible race track system.

DESCRIPTION OF THE PRIOR ART

Toy race track systems are known per se and usually include a plurality of straight and curved race-track sections that can be interconnected to form at least one closed loop. The sections may be made of flexible or rigid plastic material and are usually available as a set.

Some of the race track systems available consist of race track sections having one or two deep parallel grooves into which one or two self-propelled vehicles may travel and be kept inside the grooves by the walls on each side of each groove. The systems that have two parallel grooves may also include a race track section permitting the vehicles to switch from one groove to the other. These systems will be hereinafter referred to as "speedway".

Other race track systems consist of race track sections having one or two central recesses into which a downwardly projecting pin protruding from the bottom of a wheeled vehicle may fit. The central recess provides lateral support for the vehicle in order to keep the vehicle on the track, and may also include a metallic conductor to provide an electric power source for the vehicle, or any other system for moving the vehicle along the race track. These systems will be hereinafter referred to as "grand prix".

However, the main disadvantage with these systems is their lack of versatility. Once assembled, a race track system with two deep grooves for a pair of vehicles to race around, i.e. a "speedway" circuit, may not be adapted to obtain a race track having a central recess for a single wheeled vehicle to tour around and thus form a "grand prix" circuit.

SUMMARY OF THE INVENTION

It is an object of the present invention to provide a race track section which overcomes the above-noted disadvantages in the prior art and is versatile.

In accordance with the invention, this object is achieved with a reversible track section for a toy car circuit. The reversible track section has a length, two opposite ends, two opposite sides, a top surface and a bottom surface and comprises:

- a thin, elongated plate including a central recess on the top surface, the central recess being of given height and rectangular cross-section and extending over the length defining two narrow pathways on the bottom surface; and
- a pair of longitudinal flanges on each side, extending perpendicular to the top surface, where

- the longitudinal flanges are of the same height as the central recess and each is provided with an integral, outwardly projecting extension of constant width;
- the extension has a top surface, a bottom surface, a lateral surface, a thickness smaller than the height of the corresponding longitudinal flange, including a central portion and opposite ends thicker than the central portion, provided with alternating studs and cavities to receive the studs along the length on both the extension top and bottom surfaces and with an outwardly projecting stud extending perpendicularly to the lateral surface on each of the end portions.

It is also an object of the invention to provide a kit for building a "speedway" or "grand prix" circuit forming at least one closed loop.

In accordance with the invention, this object is achieved with a kit comprising a plurality of race track sections as described above, where some of the sections are straight and some of the sections are curved, such that, in use, a plurality of the reversible race track sections may be interconnected in series to form at least one closed loop with the top surface oriented upwardly to form a "grand prix" circuit for a wheeled vehicle having a downwardly projecting pin designed to fit into the central recess to help guide the wheeled vehicle around the circuit, or, alternatively, the plurality of reversible race track sections may be reversed and interconnected in series to form at least one closed loop with the bottom surface oriented upwardly to form a "speedway" circuit for a pair of wheeled vehicles designed to fit within the two narrow pathways.

BRIEF DESCRIPTION OF THE DRAWINGS

The present invention and its advantages will be more easily understood after reading the following non-restrictive description of preferred embodiments thereof, made with reference to the following drawings, where.

DESCRIPTION OF A PREFERRED EMBODIMENT OF THE INVENTION

Figure 1:
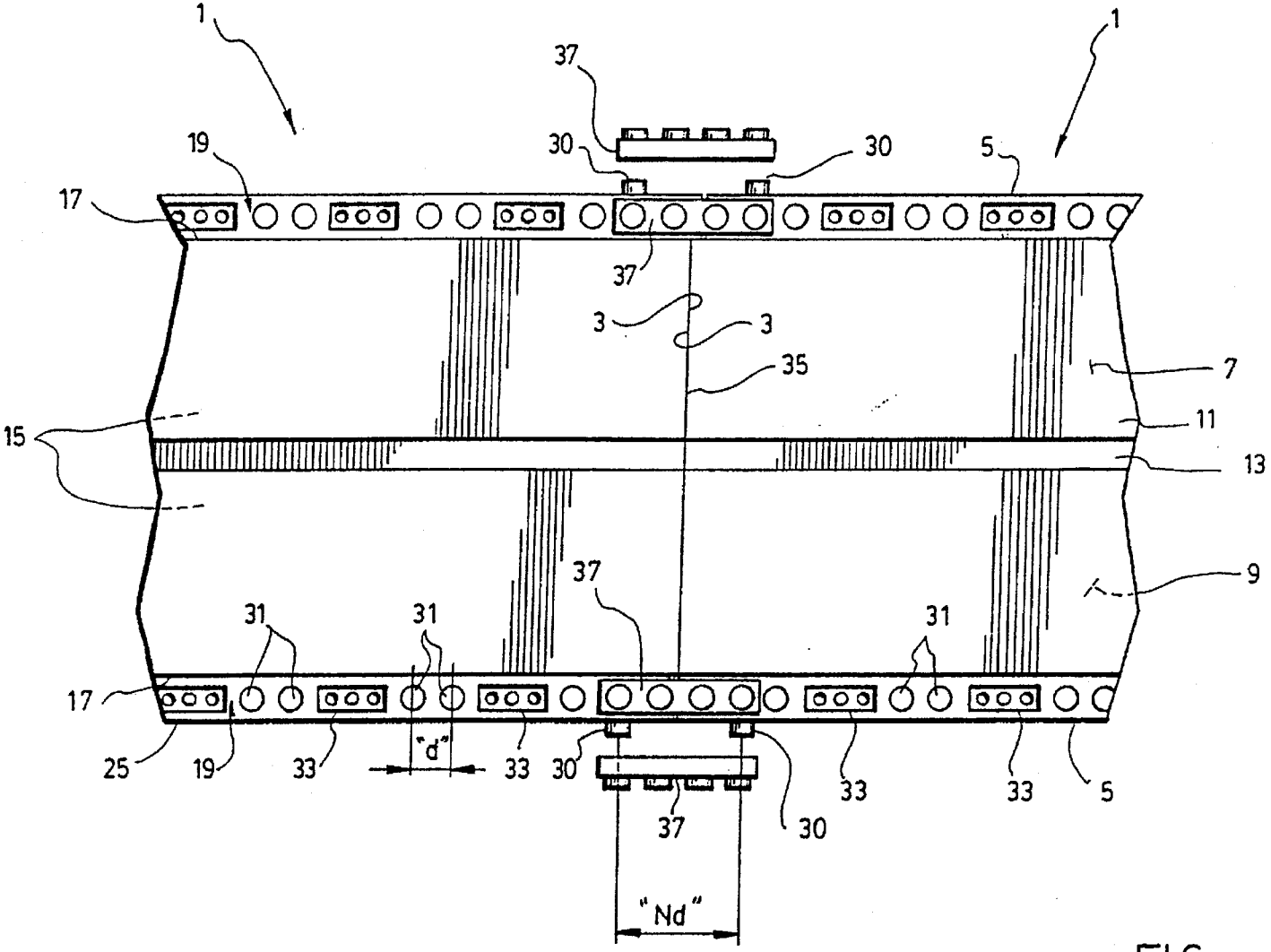
FIG. 1 is a top plan view of a portion of two reversible race track sections according to the invention.

FIG. 1 represents a portion of two interconnected reversible race track sections 1 according to the invention, each having a length, two opposite ends 3, two opposite sides 5, a top surface 7 and a bottom surface 9. As each of these sections are identical, the same reference numbers will be used to represent the same structural components.

The reversible race track section 1 according to the invention comprises a thin, elongated plate 11 including a central recess 13 on the top surface 7, the central recess 13 being of given height and rectangular cross-section extending over the length of the reversible race track section 1 and defining two narrow pathways 15 on the bottom surface 9, and a pair of longitudinal flanges 17 on each side 5 of the section 1. The longitudinal flanges 17 extend perpendicular to the top surface 7 and towards the bottom surface 9 and are of the same height as the central recess 13. Each of the longitudinal flanges 17 is provided with an integral, outwardly projecting extension 19 having a top surface 21, a bottom surface 23, a lateral surface 25 and a thickness smaller than the height of the corresponding longitudinal flange 17. The extension 19 has a central portion 27 and the extension opposite ends 29 which are thicker than the central portion 27, and is provided with alternating studs 31 and cavities 33 to receive a stud from a construction block along its length on both the extension's top 21 and bottom 23 surfaces and an outwardly projecting stud 30 extending perpendicularly to the lateral surface 25 on each of the end portions 29.

Figure 2:
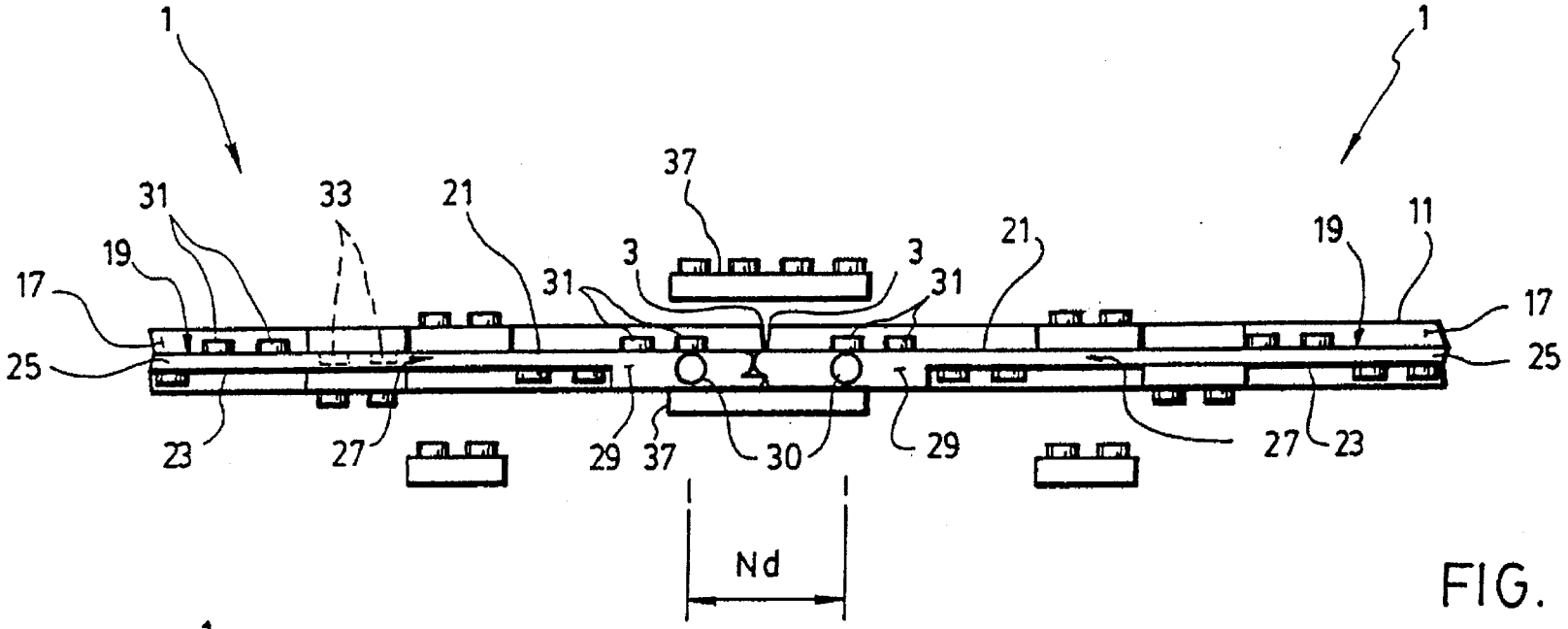
FIG. 2 is a side view of a portion of two interconnected reversible race track sections according to the invention.
Figure 3:
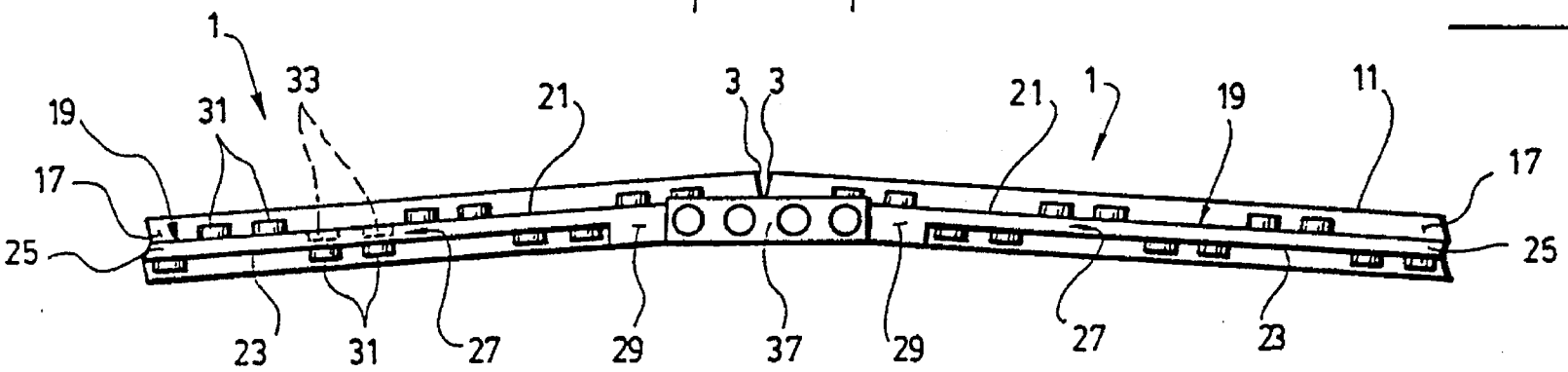
FIG. 3 is a side view of a portion of two reversible race track sections interconnected at an angle according to the invention.

The studs 31 and cavities 33, preferably aligned in pairs of studs 31 and pairs of cavities 33, are each separated by a distance d and each of the outwardly projecting studs 30 is located at a multiple of the distance d from each of the opposite ends 3, such that when two reversible track sections 1 are interconnected at a junction 35, the distance between the two outwardly projecting studs 30 on the reversible track sections 1 near the junction 35 is an integer multiple of the distance d, as shown on FIG. 2. Thus, the reversible track sections 1 may be fastened together with one or more connector blocks 37, shaped in such a manner as to fit either over the studs 31 near the opposite ends 3 or under the cavities 33 near the opposite ends 3, as better shown in FIG. 2 or over said outwardly projecting studs 30, as better shown in FIG. 3.

Figure 6:
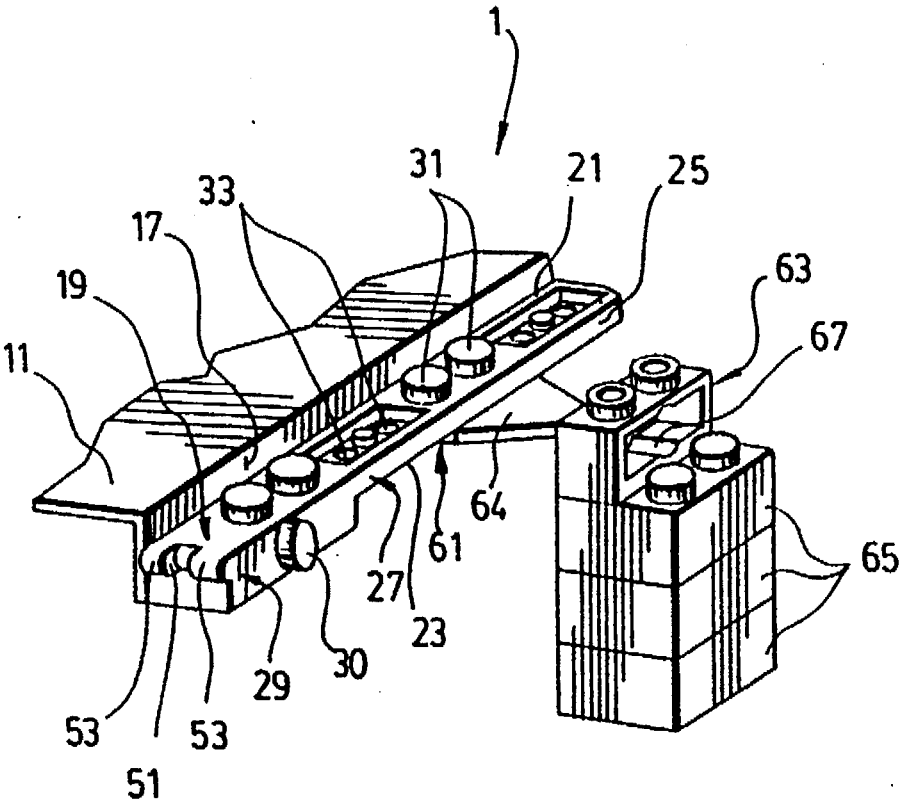
FIG. 6 is a perspective view of it riser block and a support block according to the invention.

Preferably, the reversible track section 1 further comprises means to interconnect the reversible track section 1, such as tongues 51 and grooves 53 projecting longitudinally on the opposite ends 29 of each of the extensions 19. Thus, the reversible track sections 1 may be interconnected by aligning the tongues 51 and grooves 53 of one reversible track section 1 with the corresponding tongues 51 and grooves 53 of another reversible track section 1 in order to snap-lock the two sections together. Preferably, the tongues 51 and grooves 53 are oriented vertically, as shown on FIG. 6, so as to permit interconnection at an angle, as better shown in FIG. 3.

Figure 4:
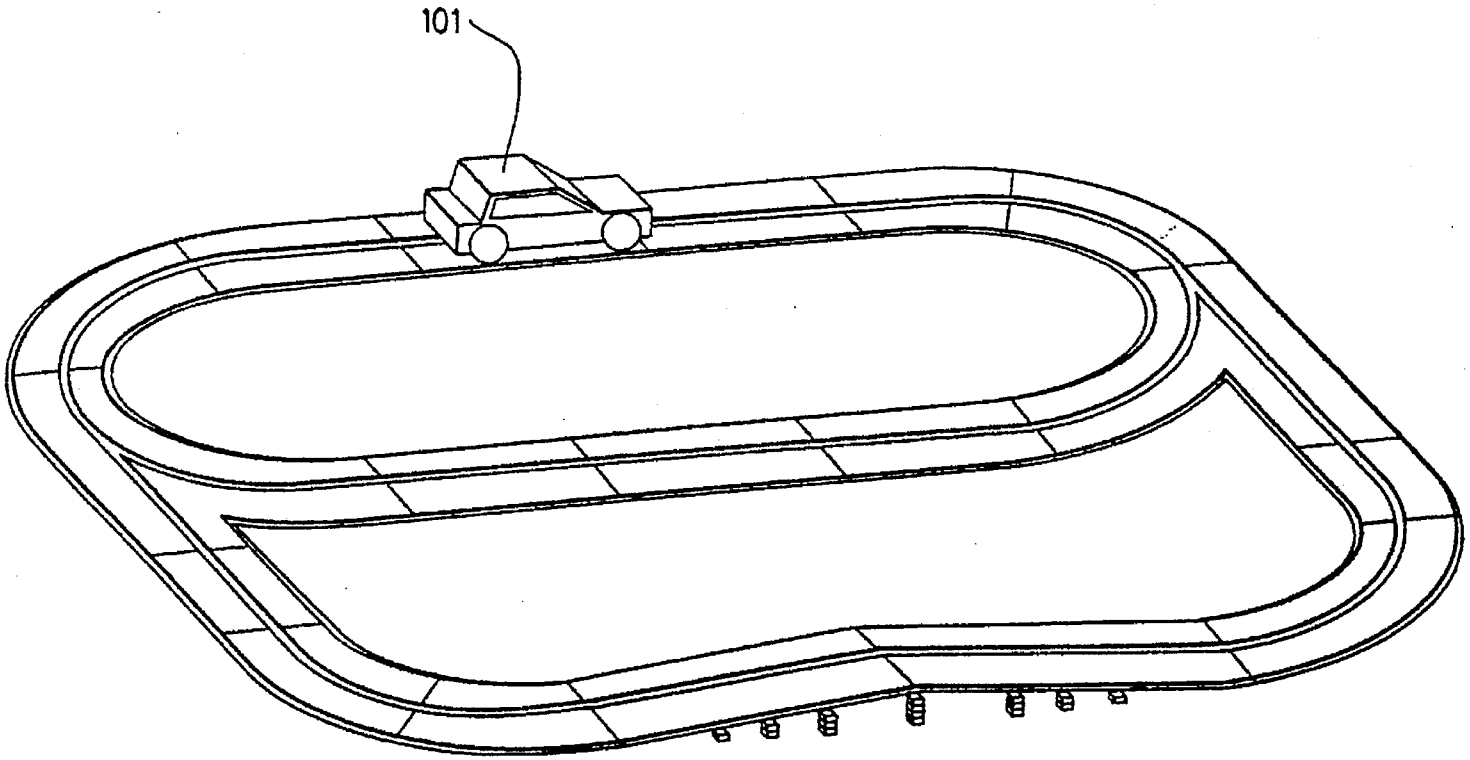
FIG. 4 is a schematic representation of an assembled toy race car "grand prix" circuit according to the invention.
Figure 5:
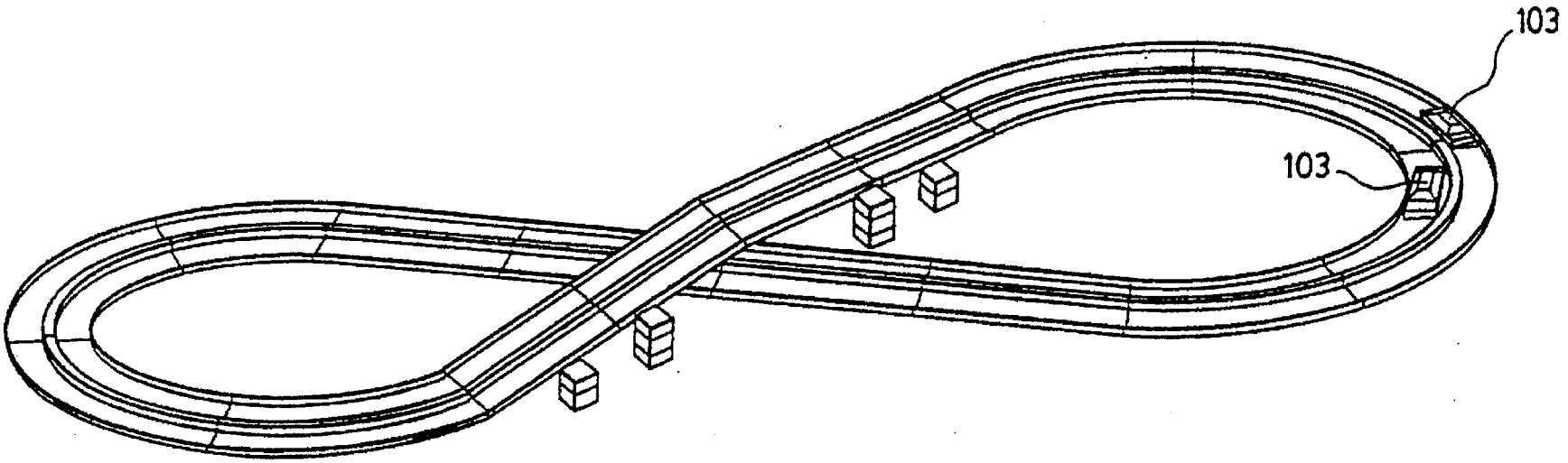
FIG. 5 is a schematic representation of an assembled toy race car "speedway" circuit according to the invention.
Figure 7:
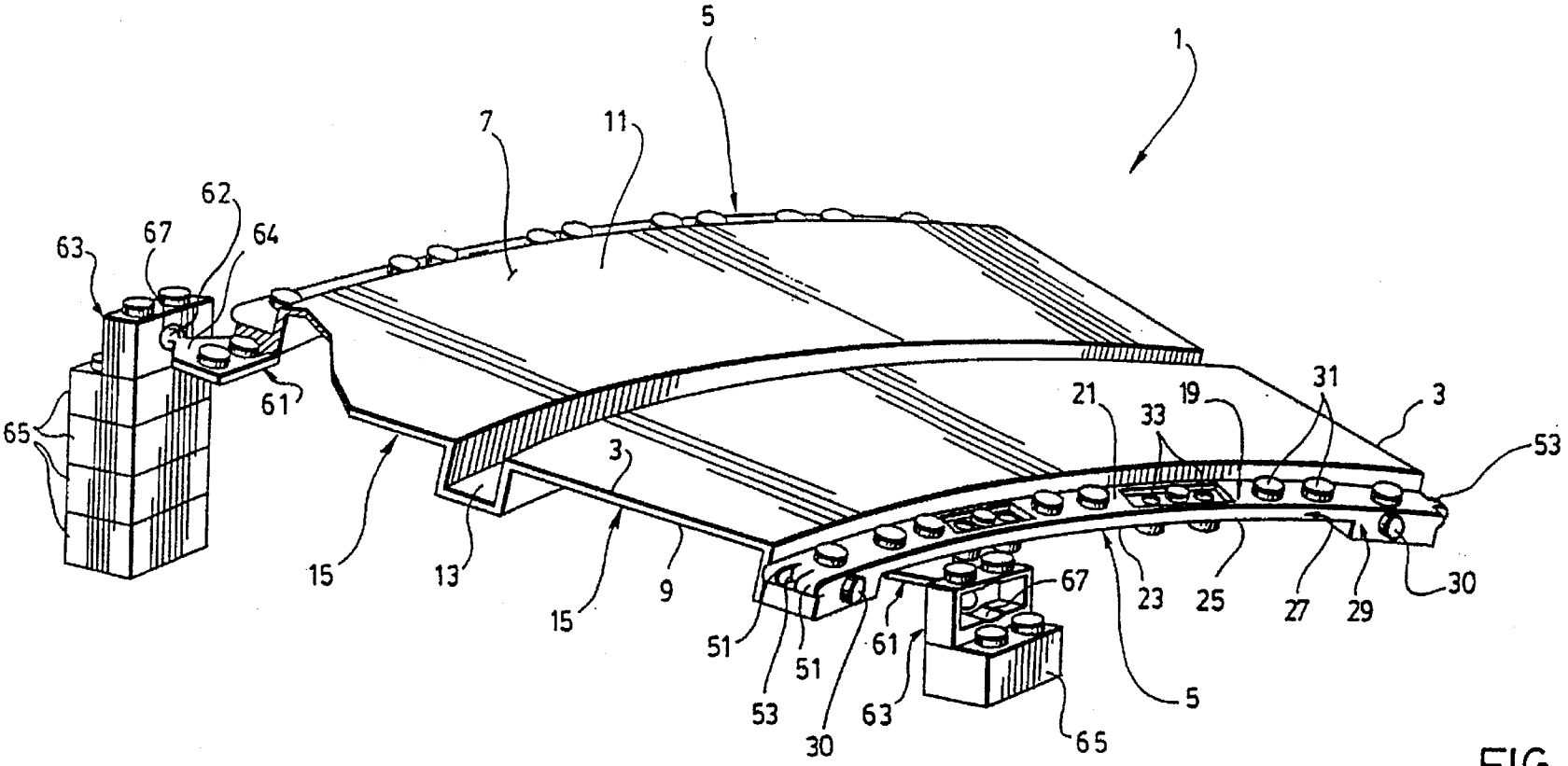
FIG. 7 is a perspective view of an assembled embodiment of a riser block and a support block.

The possibility of an angled interconnection permits assembly of a plurality of reversible track sections 1 in order to form, for example, an overpass or a bridge, as illustrated on FIGS. 5 and 4, respectively. To this effect, the reversible track sections 1 may be raised and lowered with the use of cooperating riser blocks 63 and support blocks 61, as better shown in FIGS. 6 and 7. The support blocks 61 are designed to snap over the studs 31 or under the cavities 33 and the riser blocks 63 are stackable on one or more construction toy blocks 65. The support blocks 61 have an outwardly projecting winglet 64 having a ball 62 at its extremity, better shown on FIG. 7, and the riser blocks 63 have an opening 67 designed to receive the ball 62 so as to form a universal joint when the ball 62 is inserted into the opening 67. Thus, the use of a universal joint permits not only raising and lowering of a portion of the circuit, but also permits construction of a portion of the circuit at an angle with respect to the horizontal, as illustrated in FIG. 7, by varying the number of construction toy blocks 65 on either side 5 of the reversible track section 1.

In use, some of the reversible track sections 1 are straight and some of the reversible track sections 1 are curved and are interconnected in series with the top surface 7 oriented upwardly to form a "grand prix" circuit for a wheeled vehicle 101 having a downwardly projecting pin 102 designed to fit in the central recess 13 to help guide the wheeled vehicle 101 around the circuit, as illustrated in FIG. 4 or, alternatively, are interconnected in series with the bottom surface 9 oriented upwardly to form a "speedway" circuit for a pair of wheeled vehicles 103 designed to fit within the two narrow pathways 15, as illustrated on FIG. 5. In practice, the reversible track sections 1 are interconnected in order to form at least one closed loop.

The reversible track sections 1 may also be interconnected in a "grand prix" circuit so as to order to form more than one loop as shown on FIG. 4, by adding at least two directional platforms 71 for switching the wheeled vehicle 101 from one loop to another. This directional platform 71 has a straight portion 73, similar in shape and structure to a straight reversible race track section 1, in combination with a curved section 75, similar in shape and structure to a curved reversible race track section 1, each section having a central recess 13' intersecting at a junction 77 and having a common portion 13". The common portion 13" has two opposite longitudinal walls 79, and forms a substantially Y-shaped central recess with the central recesses 13' of the straight portion 73 and the curved portion 75.

Figure 8B:
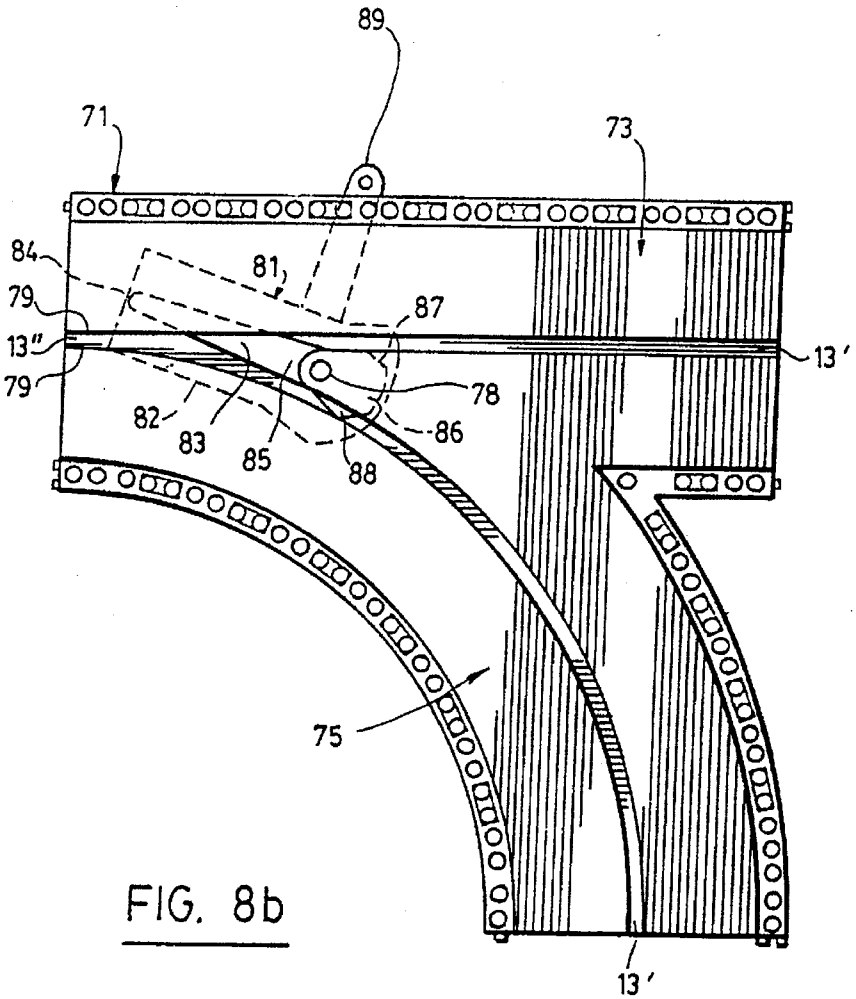
FIG. 8*b* is a top plan view of the directional platform of FIG. 8*a* oriented to permit passage in a curved path.
Figure 8A:
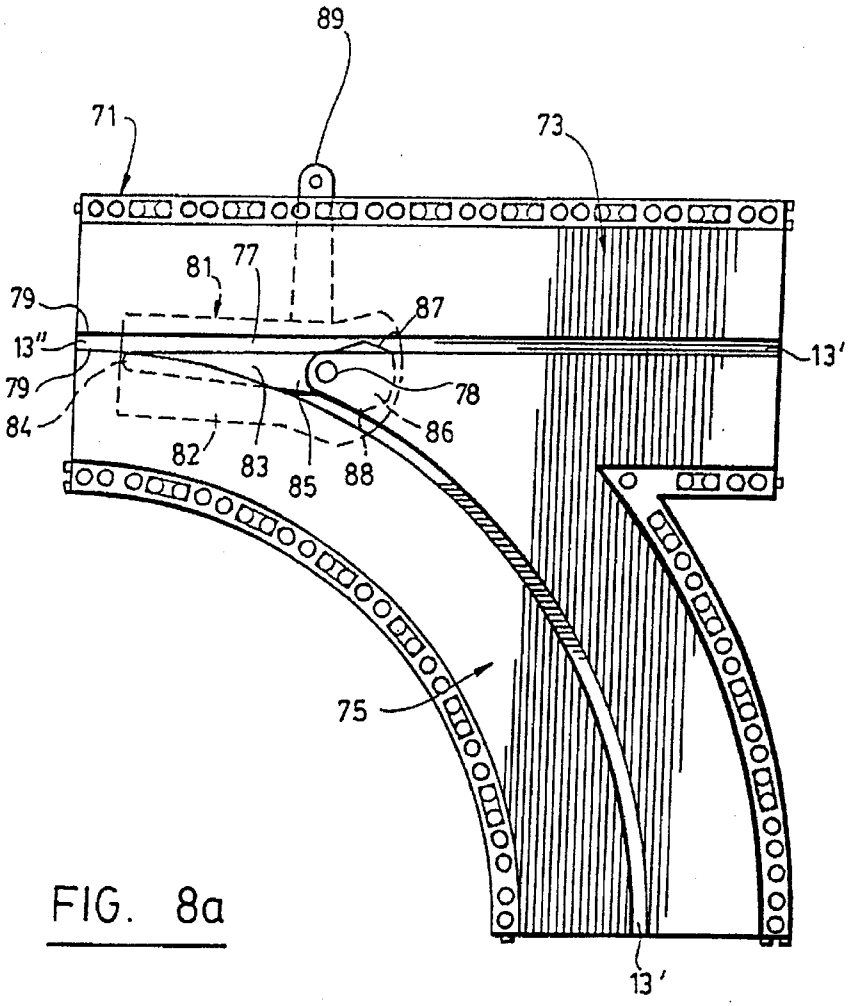
FIG. 8*a* is a top plan view of the directional platform used in a "grand prix" circuit according to the invention oriented to permit passage in a straight path.
Figure 9A:
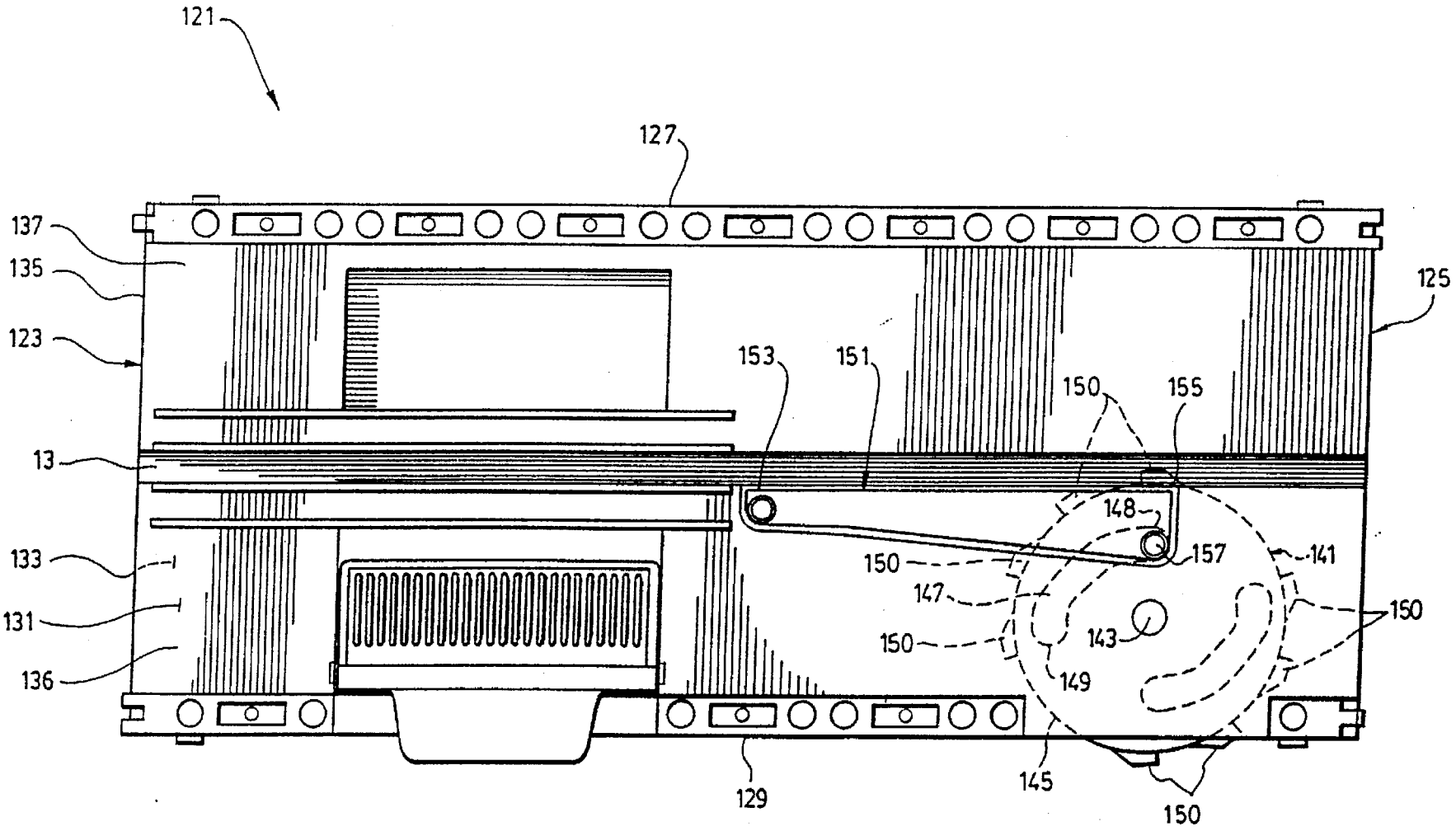
FIG. 9*a* is a top plan view of the serf-operated stopping pit used in a "grand prix" circuit according to the invention with the stopper bar aligned to permit passage.
Figure 9B:
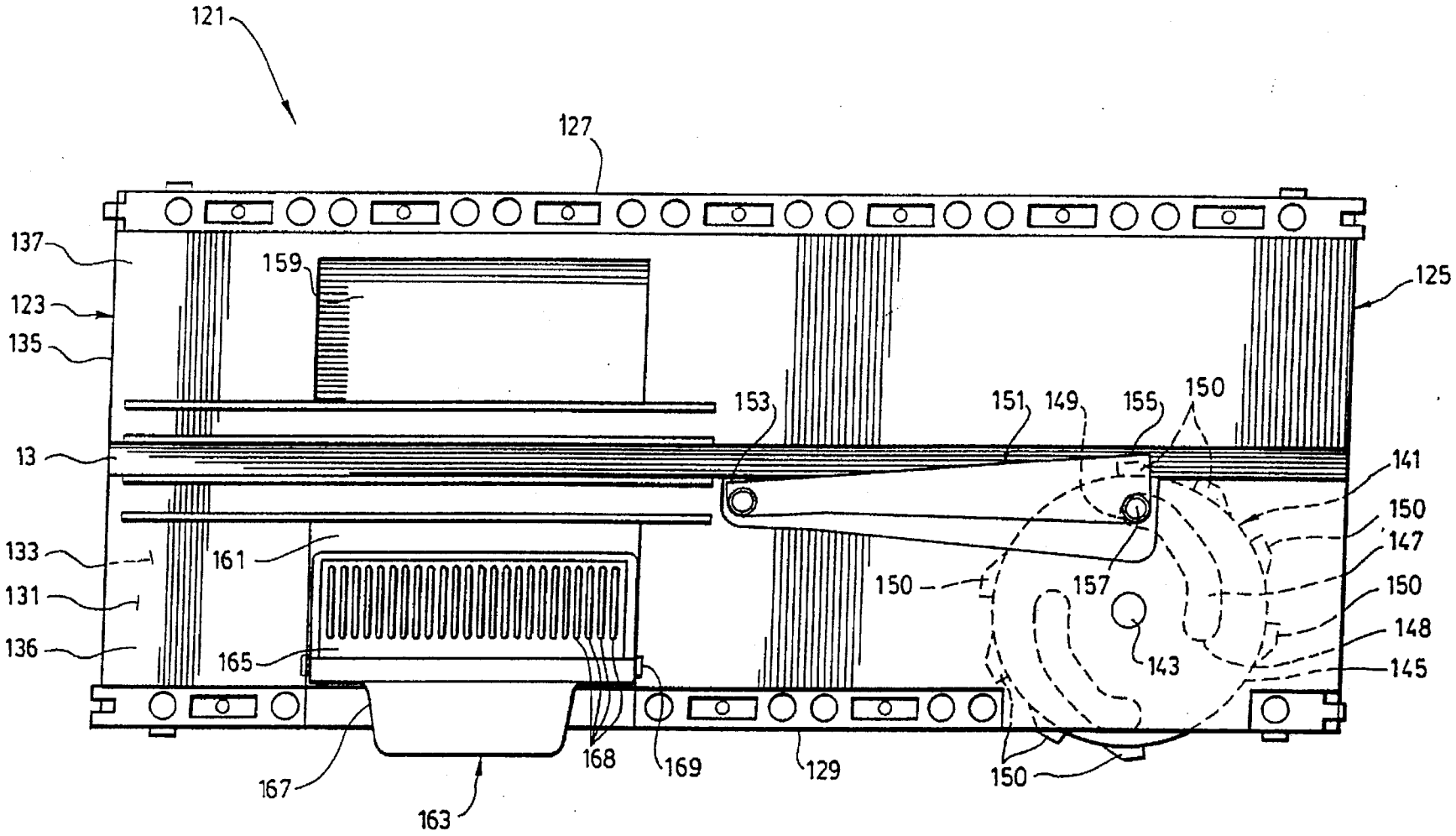
FIG. 9*b* is a top plan view of the self-operated stopping pit of FIG. 9*a* with the stopper bar aligned to block passage.

The directional platform 71 further comprises a switching device 81 mounted at the apex 78 of the Y-shaped central recess. This switching device 81 comprises a thin platform 82 located at the bottom surface 9, pivotably connected to the apex 78, and an elongated tongue 83, having opposite ends 84, 85, mounted on the platform 82 and having a height substantially equal to the central recess height 13', where one of the opposite ends 84 extends in the direction of the common portion 13' and the other opposite end 85 is located at the apex 78. The switching device 81 also comprises a head 86 having outwardly projecting winglets 87, 88 extending alternately in one or the other of the paths defined by the Y-shaped central recess and a switching arm 89, fastened to the thin platform 82, extending outwardly towards the straight side 73. The common portion central recess 13" has longitudinal openings (not shown) on each of the opposite walls 79 such that the elongated tongue 83 may pivot alternatively into one or the other of said longitudinal openings. In use, when the elongated tongue 83 is oriented towards the curved portion 75 thereby directing the wheeled vehicle 101 in the straight path, as shown in FIG. 8*a*, one of the outwardly projecting winglets 87 extends in the central recess 13' of the straight side 73 such that the downwardly projecting pin 102, as the wheeled vehicle 101 travels in the straight path, impacts the winglet 87 and pivots the elongated tongue 83 towards the straight portion 73. Thus, on the next passage, the wheeled vehicle 101 will be directed in the curved path. When the elongated tongue 83 is oriented towards the straight portion 73 thereby directing the wheeled vehicle in a curved path, as shown on FIG. 8*b*, the other outwardly projecting winglet 88 extends in the central recess of the curved side 75 such that the downwardly projecting pin 102, as the wheeled vehicle 101 travels in the curved path, impacts the winglet 88 and pivots the elongated tongue 83 towards the curved portion 75. Thus, on the next passage, the wheeled vehicle 101 will be automatically switched to the straight path. Alternatively, the switching arm 89 may be used to manually pivot the elongated tongue 83 towards either the straight path or the curved path at will.

The "grand prix" circuit may also include a self-operating stopping pit 121 having a construction similar in shape and structure to the reversible race track section of FIG. 1, and thus only the different structural components have been identified, for the sake of clarity.

The sell-operating stopping pit 121 has length, a from end 123, a back end 125, two opposite sides 127, 129, a top surface 131 and a bottom surface 133. The sell-operating stopping pit 121 comprises a thin, elongated plate 135 including a central recess 13 of given height and rectangular cross-section, extending over the length and towards the bottom surface 133, and defining a first 136 and second 137 flat sections on the top surface 131.

A round selector 141 is rotatably mounted about a central axis 143 under the first flat section 136 near the back end 125. The round selector 141 has a circumference 145, at least one arcuate slot 147 having a beginning 148 and an end 149, an outward progression and a plurality of projections 150 along the circumference 145, projecting outwardly into the central recess 13 and outside one of said longitudinal flanges 17 through a longitudinal slot (not shown). A stopper bar 151, having pivot end 153 and a stopper end 155 is mounted on the first flat section 136. The pivot end 153 is pivotably fastened to the top surface 131 approximately in the center of the self-operated stopping pit 121. The stopper end 148 has a downwardly projecting rivet 157 such that the rivet 157 is engaged in the arcuate slot 147.

Figure 10A:
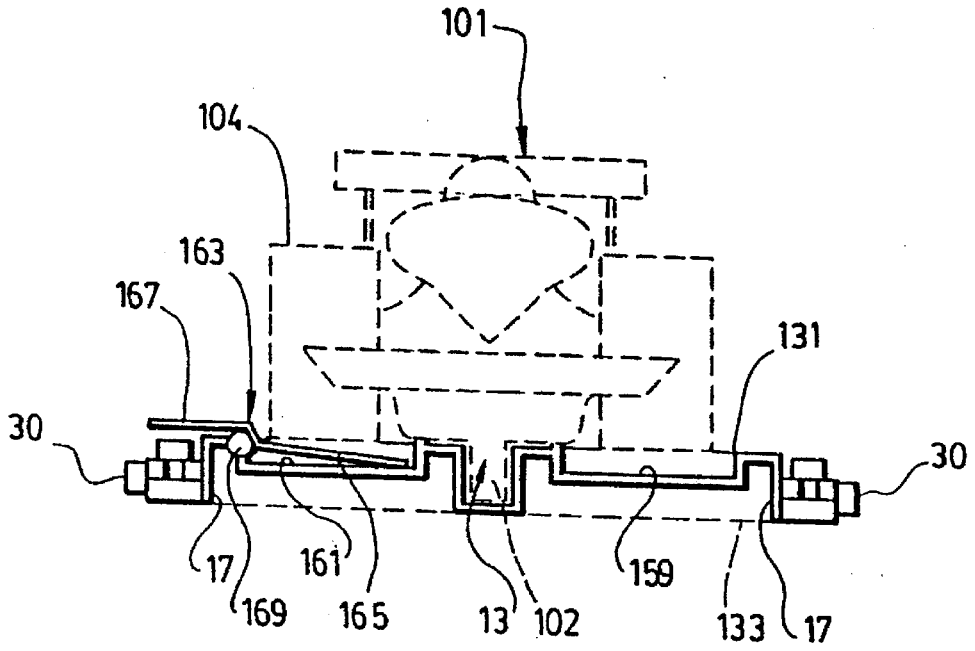
FIG. 10*a* is a schematic cross-sectional view of a stopped wheeled vehicle in the self-operated stopping pit of FIGS. 9*a* and 9*b* showing the start button at rest.
Figure 10B:
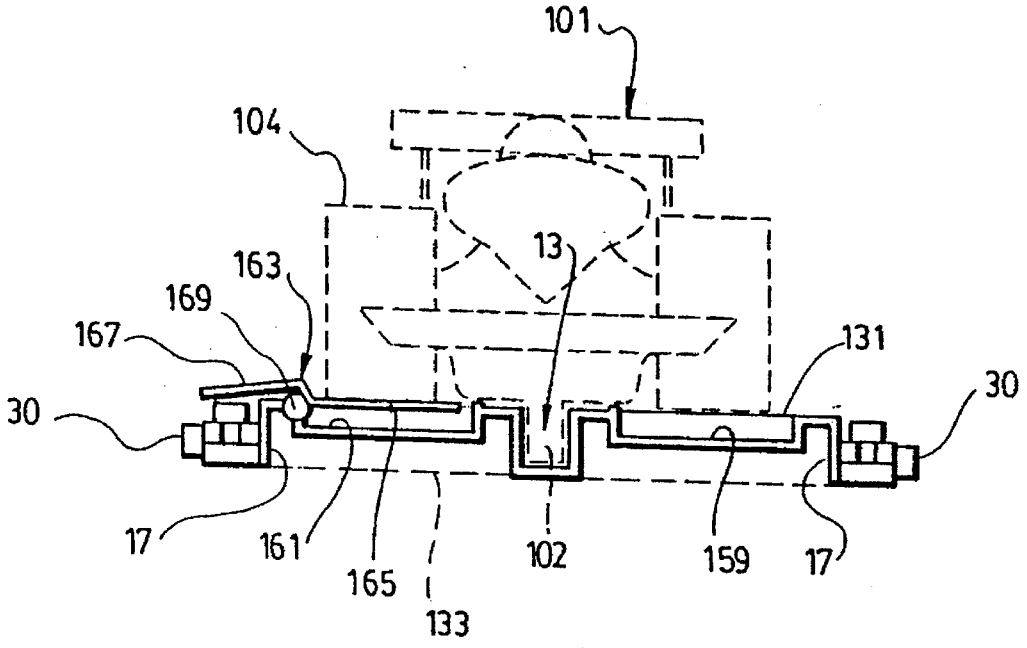
FIG. 10*b* is a schematic cross-sectional representation of the operation of the start button of the self-operated stopping pit of FIGS. 9*a* and 9*b*.

The self-operating stopping pit 121 also has two parallel depressions 159, 161 on the first 136 and second 137 flat surfaces near the front end 123. A start button 163, having a lower section 165 located in said first flat section depression 161, an upper section 167 located above said top surface 131 and projecting outwardly, is pivotably fastened with a pin 169 along a longitudinal axis, to the first flat section 136 near the longitudinal flange 17 on the side 121 (see more particularly FIGS. 10*a* and 10*b*).

In use, when the wheeled vehicle 101 travels from the front end 123 to the back end 125 along the self-operated stopping pit 121, the downwardly projecting pin 102 engages one of the projections 150 and rotates the selector 141 incrementally clockwise. The arcuate slot 147 progression pushes the rivet 157 towards the central recess 13, thereby pushing the stopper end 155 of the stopper bar 151 inside the central recess 13 such that after a number of passes, when the rivet 157 is located at the end 149 of the arcuate slot 147, the stopper end 155 blocks the central recess 13 and immobilizes the wheeled vehicle 101 in such a manner that the drive wheels 104 are located above the parallel depressions 159, 161 and thus are have no traction. The selector 141 may then be reset manually by turning the selector 141 counterclockwise until the rivet 157 is located at the beginning 148 of the arcuate slot 147 to disengage the downwardly projecting pin 102. The wheeled vehicle 101 may then be freed by pressing downwardly on the upper section 167 of the start button such that the drive wheel 104 located above the depression 161 on the first flat section 136 regains traction on the lower section 165 of the start button 163 and thus may proceed along said dosed circuit, as better shown on FIG. 10*b*. Preferably, the lower section 165 includes parallel corrugations 168 to improve the traction of the drive wheel 104 as is comes into contact with the lower section 165.

Although the present invention has been explained hereinabove by way of a preferred embodiment thereof, it should be pointed out that any modifications to this preferred embodiment within the scope of the appended claims is not deemed to alter or change the nature and scope of the present invention. For example, the disclosed reversible race track section could include two parallel grooves on its top surface, defining three parallel narrow pathways on its bottom surface.

What is claimed is:

1. A reversible track section for a toy car circuit, said section having a length, two opposite ends, two opposite sides, a top surface and a bottom surface and comprising:

a thin, elongated plate including a central recess on said top surface, said central recess being of given height and rectangular cross-section and extending over said length, said central recess defining two narrow pathways on said bottom surface; and a pair of longitudinal flanges on said opposite sides, extending perpendicular to said top surface, said longitudinal flanges being of the same height as said central recess and each of said longitudinal flanges being provided with an integral, outwardly projecting extension of constant width, said extension having a top surface, a bottom surface, a lateral surface and a thickness smaller than the height of a corresponding one of said longitudinal flange; said extension having a central portion and opposite ends thicker than said central portion, said extension being provided with alternating studs and cavities along said length on both said extension top and bottom surfaces and with an outwardly projecting stud extending perpendicularly to said lateral surface on each of said end portions.

2. A reversible track section according to claim 1, wherein:

adjacent ones of said studs and cavities are separated by a distance d; and each one of said outwardly projecting stud is located at a multiple of said distance d from a corresponding one of said opposite ends.

3. A reversible track section according to claim 2, further comprising means to interconnect said reversible track section.

4. A reversible track section according to claim 3, wherein said means to interconnect comprise:

grooves and tongues projecting longitudinally on each of said opposite ends of each of said extensions.

5. A reversible track section according to claim 4, wherein said alternating studs and cavities are arranged in longitudinal pairs of studs and longitudinal pairs of cavities.

6. A reversible track section according to claim 5, wherein said track section is straight.

7. A reversible track section according to claim 5, wherein said track section is curved.

8. A kit for assembling a toy car circuit, said kit comprising:

a plurality of reversible track sections, each of said sections having a length, two opposite ends, a top surface and a bottom surface, each of said reversible track sections comprising:

a thin, elongated plate including a central recess on said top surface, said central recess being of given height and rectangular cross-section and extending over said length, said central recess defining two narrow pathways on said bottom surface; and a pair of longitudinal flanges on said opposite sides, extending perpendicular to said top surface, said longitudinal flanges being of the same height as said central recess and each of said longitudinal flanges being provided with an integral, outwardly projecting extension of constant width, said extension having a top surface, bottom surface, a lateral surface and a thickness smaller than the height of a correspondence one of said longitudinal flange; said extension having a central portion and opposite ends thicker than said central portion, said extension being provided with alternating studs and cavities along said length on both said extension top and bottom surfaces and with an outwardly projecting stud extending perpendicularly to said lateral surface on each of said end portions;

where some of said reversible track sect, ions are straight and some of said reversible track sections are curved, whereby, said plurality of reversible track sections, are adapted to be interconnected to form at least one closed loop with said top surface oriented upwardly to form a "grand prix" circuit for a wheeled vehicle having a downwardly projecting pin designed to fit into said central recess to help guide said wheeled vehicle around the circuit, or, alternatively, said plurality of reversible track sections are adapted to be reversed and interconnected to form at least one closed loop with said bottom surface oriented upwardly to form a "speedway" circuit for a pair of wheeled vehicles designed to fit within said two narrow pathways.

9. A kit according to claim 8, wherein:

adjacent ones of said studs and cavities of said reversible track sections are separated by a distance d; and each one of said outwardly projecting studs is located at a multiple of said distance d from a corresponding one of said opposite ends, whereby, in use, when a first of said reversible track sections is interconnected with a second of said reversible track sections at a junction, the distance between an outwardly projecting stud on said first reversible track section near said junction and an outwardly projecting stud on said second reversible track section near said junction is an integer multiple of said distance d.

10. A kit according to claim 9, wherein said plurality of reversible track sections further comprise means to interconnect said reversible track sections.

11. A kit according to claim 10, wherein said means to interconnect comprise:

grooves and tongues projecting longitudinally on each of said opposite ends of each of said extensions;

whereby, one of said plurality of reversible track sections is adapted to be interconnected to another said reversible track section by aligning said tongues and grooves of said one section with corresponding tongues and grooves of said another section in order to snap-lock the sections together.

12. A kit according to claim 11, wherein said alternating studs and cavities are arranged in longitudinal pairs of cavities.

13. A kit according to claim 12, wherein said kit further comprises a plurality of connector blocks, shaped in such a manner as to fit either over said studs or under said cavities or over said outwardly projecting studs.

14. A kit according to claim 13, wherein said kit further comprises means to raise and lower a part of said at least one closed loop.

15. A kit according to claim 14, wherein said means to raise and lower a part of said at least one closed loop comprise:

a set of support blocks and riser blocks cooperating together, said support blocks being designed to snap over said studs or under said cavities and said riser blocks being stackable on construction toy blocks, said support blocks having an outwardly projecting ball and said riser blocks having an opening designed to receive said ball so as to form a universal joint when said ball is inserted into said opening;

whereby, in use, at least two of said support blocks are snapped into said studs or cavities on either side of one of said plurality of reversible race track sections and at least two of said riser blocks are stacked on construction toy blocks, such that said construction toy block stacks lifts said part of said at least one loop and said universal joint permits assembly in a secure and versatile fashion.

16. A kit according to claim 13, wherein said kit further comprises a directional platform for switching said wheeled vehicle from one path to another in a "grand prix" circuit.

17. A kit according to claim 16, wherein:

said directional platform has a straight section in combination with a curved section, said sections of said platform having central recesses intersecting at a junction and having a common portion, said common portion having two opposite longitudinal walls, thereby forming a substantially Y-shaped central recess, where said directional platform has a straight side and a curved side; and said directional platform further comprises a switching device mounted at the apex of the Y-shaped central recess, whereby, in use, said directional platform may direct said wheeled vehicle into one of the two paths defined by said Y-shaped central recess.

18. A kit according to claim 17, wherein said switching device comprises:

a thin platform located at said bottom surface, pivotably connected to said apex;

an elongated tongue, having opposite ends, mounted on said platform and having a height substantially equal to said central recess height, where one of said opposite ends extends in the direction of said common portion and the other of said opposite ends is located at said apex;

a head having outwardly projecting winglets extending alternately in one or the other of said paths defined by said Y-shaped central recess;

a switching arm, fastened to said thin platform, extending outwardly towards said straight side;

wherein said common portion central recess has longitudinal openings on each of said opposite walls such that said elongated tongue may pivot alternatively into one or the other of said longitudinal openings, whereby, in use, when said elongated tongue is oriented towards said curved portion thereby directing said wheeled vehicle in said straight path, one of said outwardly projecting winglets extends in said straight path such that said downwardly projecting pin, as said wheeled vehicle travels in said straight path, impacts said winglet and pivots said elongated tongue towards said straight portion to automatically switch said wheeled vehicle to said curved path and when said elongated tongue is oriented towards said straight portion thereby directing said wheeled vehicle in said curved path, the other of said outwardly projecting winglets extends in said curved path such that said downwardly projecting pin, as said vehicle travels in said curved path, impacts said winglet and pivots said elongated tongue towards said curved portion to automatically switch said wheeled vehicle to said straight bath, or, alternatively, said switching arm may be used to pivot said elongated tongue towards either said straight path or said curved path at will.

19. A kit according to claim 13, wherein said kit further comprises a self-operating stopping pit for stopping said wheeled vehicle in a "grand prix" circuit.

20. A kit according to claim 19, wherein said self-operating stopping pit has a length, a front end and a back end, two opposite sides, a top surface and a bottom surface and comprises:

a thin, elongated plate including a central recess of given height and rectangular cross-section extending over said length and towards said bottom surface, said central recess defining a first and second flat sections on said top surface; and a pair of longitudinal flanges on each side, extending perpendicular to said top surface and towards said bottom surface, said longitudinal flanges being of the same height as said central recess and each provided with an integral, outwardly projecting extension of constant width, said extension having a top surface, a bottom surface, a lateral surface and a thickness smaller than the height of the corresponding longitudinal flange; said extension having a central portion and opposite ends thicker than said central portion, said extension being provided with alternating studs and cavities to receive said studs along said length on both said extension top and bottom surfaces and with an outwardly projecting stud extending perpendicularly to said lateral surface on each of said end portions;

a round selector, rotatably about a central axis, mounted under said first flat section near said back end, having a circumference, at least one arcuate slot having an outward progression and a plurality of projections along said circumference, projecting outwardly into said central recess and outside one of said longitudinal flanges through a longitudinal slot;

a stopper bar having pivot end and a stopper end, a straight central recess side and a selector side, mounted on said first flat section, pivotably fastened to said top surface approximately in the center of said self-operated stopping pit at said pivot end and having a downwardly projecting rivet at said stopper end such that said rivet is engaged in said arcuate slot;

two parallel depressions on said first and second flat surfaces near said front end; and a start button, having a lower section located in said first flat section depression, an upper section located above said top surface and projecting outwardly, pivotably fastened to said first flat section near one of said longitudinal flanges along a longitudinal axis;

whereby, in use, when said wheeled vehicle travels from front to back along said self-operated stopping pit, said downwardly projecting pin engages one of said projections and rotates said selector incrementally clockwise and said arcuate slot progression pushes said rivet towards said central recess, thereby pushing said stopper end of said stopper bar inside said central recess such that after a number of passes, said stopper end blocks said central recess and immobilizes said wheeled vehicle such that said drive wheels are located above said parallel depressions and thus are have no traction and where said selector may then be reset manually by turning said selector counter-clockwise to disengage said downwardly projecting pin and said wheeled vehicle may be freed by pressing downwardly on said upper section of said start button such that said drive wheel located above said depression on said first flat section regains traction on said lower section if said start button and thus may proceed along said closed circuit.

21. A kit according to claim 20, wherein said start button lower section further comprises corrugations.

* * * * *

UNITED STATES PATENT AND TRADEMARK OFFICE

CERTIFICATE OF CORRECTION

PATENT NO. : 5,657,695
DATED : August 19, 1997
INVENTOR(S) : Réal LANOIX et al.

It is certified that error appears in the above-identified patent and that said Letters Patent is hereby corrected as shown below:

Column 5, line 6:
"sell-operating" should read --self-operating--; "from" should read --front--;

Column 5, line 8:
"sell-operating" should read --self-operating;

Column 5, line 50:
"and thus are have no traction" should read --and thus have no traction--;

Column 7, line 11:
"track sect,ions" should read --track sections--;

Column 9, line 3:
"bath" should read --path--.

Signed and Sealed this

Third Day of March, 1998

Bruce Lehman

*Attest:*

BRUCE LEHMAN

*Attesting Officer*

*Commissioner of Patents and Trademarks*